US006203297B1

(12) United States Patent
Patel

(10) Patent No.: US 6,203,297 B1
(45) Date of Patent: Mar. 20, 2001

(54) FLUID FLOW DEVICE WITH IMPROVED COOLING SYSTEM AND METHOD FOR COOLING A VACUUM PUMP

(75) Inventor: Ajitkumar G. Patel, Oxford, OH (US)

(73) Assignee: Dresser Equipment Group, Inc., Carrollton, TX (US)

( * ) Notice: Subject to any disclaimer, the term of this patent is extended or adjusted under 35 U.S.C. 154(b) by 0 days.

(21) Appl. No.: 09/408,397

(22) Filed: Sep. 29, 1999

(51) Int. Cl.[7] ..... F03C 2/00
(52) U.S. Cl. ..... 418/15; 418/206.1; 418/206.4
(58) Field of Search ..... 418/15, 206.1, 418/206.4

(56) References Cited

U.S. PATENT DOCUMENTS

| | | | | |
|---|---|---|---|---|
| 973,679 | * | 10/1910 | Machlet | 418/91 |
| 1,804,604 | * | 5/1931 | Gilbert | 418/15 |
| 2,489,887 | * | 11/1949 | Houghton | 418/86 |
| 3,018,641 | * | 1/1962 | Carpigiani | 418/15 |
| 3,045,778 | * | 7/1962 | Mosbacher | 418/15 |
| 3,531,227 | * | 9/1970 | Weatherston | 418/94 |
| 4,057,375 | | 11/1977 | Nachtrieb . | |
| 4,215,977 | * | 8/1980 | Weatherson | 418/1 |
| 4,453,901 | | 6/1984 | Zimmerly . | |
| 4,511,316 | | 4/1985 | Ellis . | |
| 4,758,140 | | 7/1988 | Durach et al. . | |
| 4,971,260 | | 11/1990 | Taylor . | |
| 5,090,879 | | 2/1992 | Weinbrecht . | |
| 5,439,358 | * | 8/1995 | Weinbrecht | 418/15 |
| 5,702,240 | | 12/1997 | O'Neal et al. . | |
| 6,062,827 | * | 5/2000 | Shu | 418/206.4 |

FOREIGN PATENT DOCUMENTS

| | | | | |
|---|---|---|---|---|
| 622873 | * | 5/1949 | (GB) | 418/15 |
| 64-032085 | * | 2/1989 | (JP) | 418/15 |
| 1675582 | * | 9/1991 | (SU) | 418/206 |

* cited by examiner

*Primary Examiner*—Thomas Denion
*Assistant Examiner*—Theresa Trieu
(74) *Attorney, Agent, or Firm*—Haynes and Boone LLP

(57) ABSTRACT

A fluid flow device and method are provided according to which one or more impellers are mounted for rotation in a chamber formed in a casing. Fluid to be processed is introduced into an inlet formed in the casing and at least one impeller is mounted for rotation in the chamber to flow the fluid through the casing and through an outlet in the casing. The impeller also draws atmospheric air into the chamber through an air inlet formed in the casing, and any backflow of the fluid from the fluid outlet into the air inlet is prevented.

15 Claims, 3 Drawing Sheets

FLUID FLOW DEVICE WITH IMPROVED COOLING SYSTEM AND METHOD FOR COOLING A VACUUM PUMP

BACKGROUND

This invention relates to a fluid flow device, such as a vacuum pump, blower, or compressor, and, more particularly to such a device having an improved system for cooling the device during operation.

Positive displacement fluid flow devices, such as vacuum pumps, blowers, and compressors are well know and provide certain advantages over other types of units such as fan-type blowers, turbine pumps and reciprocating pumps. For example, the positive displacement devices have no valves, pistons or other reciprocating mechanical parts. Also, they enjoy a relatively high volumetric capacity and operate with little or no backflow. As a result, they are relatively simple in construction and operation, yet are relatively rugged and reliable.

A typical positive displacement fluid flow device of the above type utilizes one or more impellers that are rotatably mounted in a chamber formed in a casing, or housing. An outer surface of each impeller extends with minimal clearance relative to the corresponding inner wall portion of the casing defining the chamber. Fluid to be processed, such as air, is introduced into an inlet at one end of the casing, and is trapped between the impellers and the casing, producing a vacuum which moves the gas to an outlet at the other end of the casing.

In some of these designs, a jet plenum is provided in the casing through which atmospheric air flows into the space between the lobes of the impellers and the casing during operation. This cools the trapped fluid, aids impeller movement, and reduces shock and power loss.

However there are problems associated with these types of designs. For example, the cooling air is often supplied through a manifold bolted to the casing on the discharge side thereof. However, the bolted manifold is bulky and takes up considerable space. Also, the discharge side of the casing is hot and thus heats the manifold and therefore the cooling air, which reduces its efficiency. Further, since the pressure of the fluid being processed is greater at the outlet than that at the inlet, there can be a blackflow of the relative hot fluid from the outlet back into the chamber and into the jet plenum for the cooling air. This, of course, also heats the cooling air and reduces its efficiency.

Therefore, what is needed is a positive displacement fluid flow device of the above type which minimizes any preheating of the cooling air and avoids the problems associated with a bolt-on manifold.

SUMMARY

According to an embodiment of the present invention, a fluid flow device and method are provided according to which one or more impellers are mounted for rotation in a chamber formed in a casing. Fluid to be processed is introduced into an inlet formed in the casing and at least one impeller is mounted for rotation in the chamber to flow the fluid through the casing and through an outlet in the casing. The impeller also draws atmospheric air into the chamber through an air inlet formed in the casing, and any backflow of the fluid from the fluid outlet into the air inlet is prevented.

There are several advantages associated with the above embodiment. For example, the fluid passing through the casing is cooled by the atmospheric air, which promotes impeller movement and reduces shock and power losses. Also, the above problems associated with pre-heating the cooling air are avoided.

DESCRIPTION OF THE PREFERRED EMBODIMENT

Figure 1:
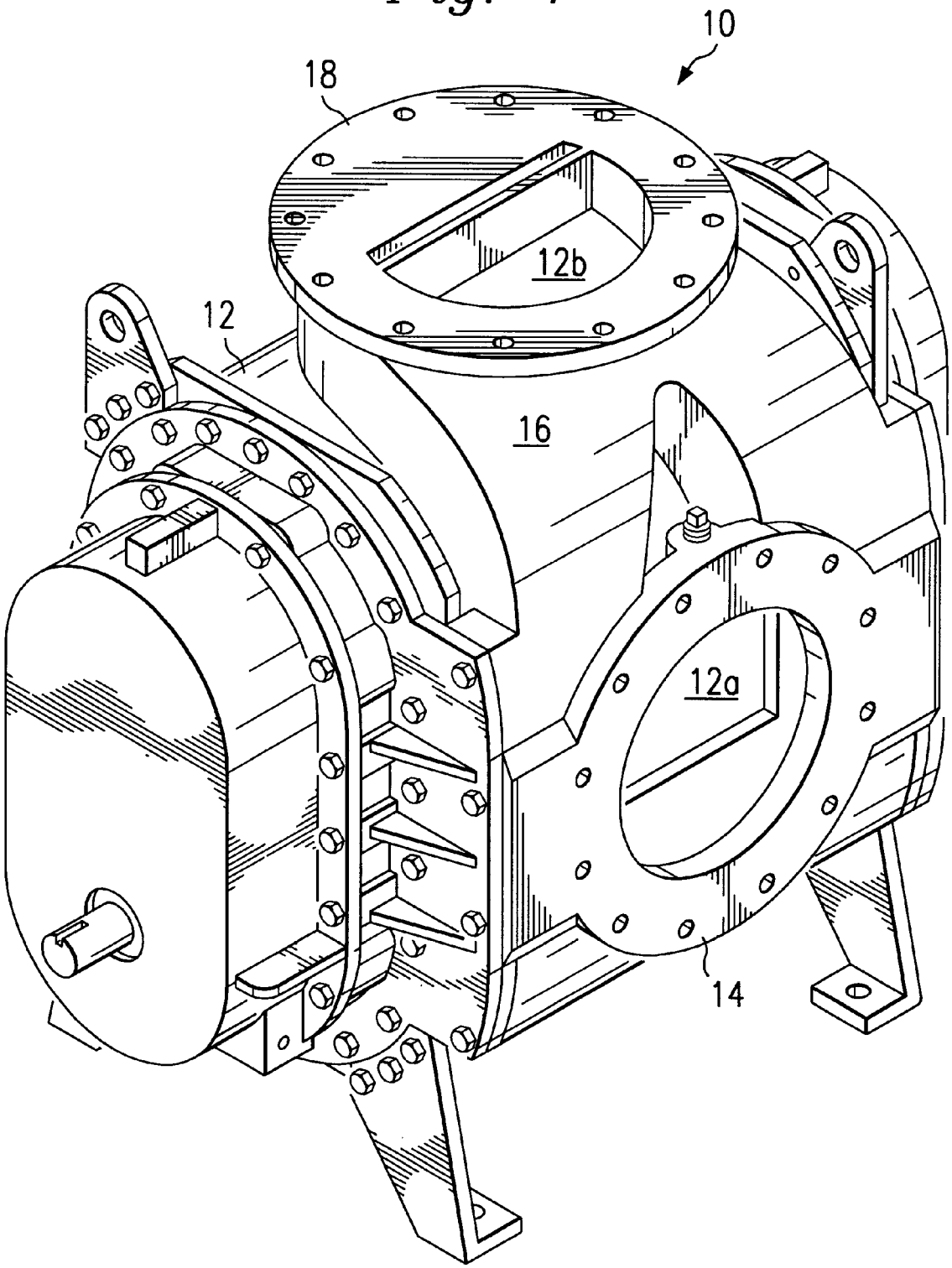
FIG. 1 is an isometric view of a fluid flow device according to an embodiment of the present invention.

With reference to FIG. 1 of the drawings, a fluid flow device is referred to, in general, by the reference numeral 10 and can be in the form of a vacuum pump, a blower, or an air compressor. The device 10 includes a casing 12 preferably of a one-piece, close-grained, cast iron construction having an inlet 12*a* formed in one side wall of the casing 12 for receiving a fluid, such as air or another gas, to be processed. A flange 14 is formed integrally with the casing and surrounds the inlet 12*a*. An oulet (not shown in FIG. 1) is provided at the other side wall of the casing for discharging the fluid.

An inlet 12*b* extends through the upper wall of the casing 12 as viewed in FIG. 1 for receiving atmospheric air for cooling the internal portion of the casing in a manner to be described. A wraparound manifold 16 is formed over a portion of the casing 12 and extends from the inlet 12*b* to an inlet (not shown in FIG. 1) formed in the bottom wall of the casing 12 for routing a portion of the atmospheric air from the former inlet to the latter inlet, as will be described. A flange 18 extends from the manifold 16 and surrounds the inlet 12*b*. Preferably, the flanges 14 and 18 and the manifold 16 are formed integrally with the casing.

Figure 2:
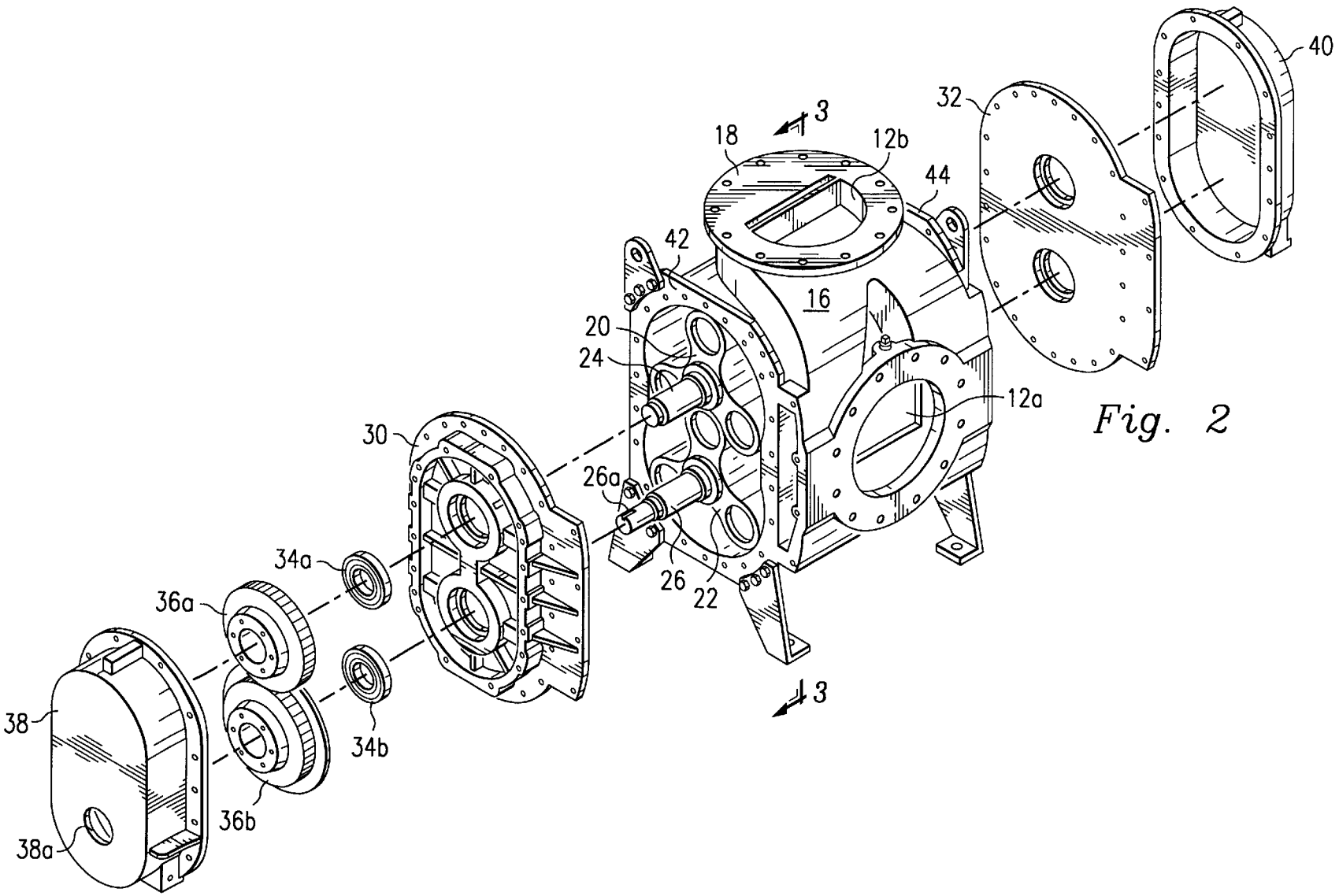
FIG. 2 is a reduced, exploded, isometric view of the device of FIG. 1.

Referring to FIG. 2, two impellers 20 and 22 are mounted on drive shafts 24 and 26, respectively, which are mounted for rotation in the casing 12 in any known manner. The impeller 22 extends just below the impeller 20 and its shaft has an extension 26*a*, for reasons to be described.

Each impeller 20 and 22 is formed by three angularly-spaced hollow cylindrical lobes extending radially outwardly from a center portion defining a bore for receiving the shafts 24 and 26, respectively. The outer surfaces of the latter center portions extending between each lobe are concave to form a series of pockets which are complementary to the convex curvature of the outer surfaces of the lobes of each impeller 20 and 22.

The impellers 20 and 22 are positioned in an intermeshing relationship so that during rotation of the impellers, each lobe of the impeller 20 will periodically nest in a corresponding concave pocket of the impeller 22, and visa versa. As a result, rotation of the shaft 26 causes corresponding rotation of the impeller 22 which, in turn, drives the impeller 20 in an opposite direction.

A pair of cover plates 30 and 32 extend over the respective ends of the casing 12 and each has two openings formed therethrough for receiving the respective shafts 24 and 26. Two piston rings 34*a* and 34*b* and two timing gears 36*a* and 36*b* are mounted over those portions of the shafts 24 and 26, respectively, extending axially outwardly from the plate 30 and function in a conventional manner.

Two flanged end caps 38 and 40 are mounted over corresponding flanges 42 and 44, respectively formed at the respective ends of the casing 12, and each end cap is bolted to its corresponding flange in a conventional manner. An opening 38*a* extends though the cap 38 through which the extension 26*a* of the shaft 26 extends. It is understood that a power source (not shown), such as a motor, engine, or the like, is adapted to be coupled to the shaft extension 26*a* and rotate same, which causes corresponding rotation of the impeller 22, and therefore the impeller 20.

Figure 3A:
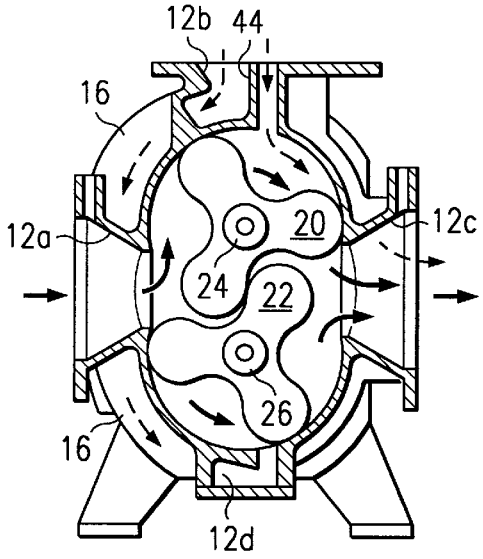
FIGS. 3*a*–3*c* are sectional views taken along the line 3—3 of FIG. 2 and depicting three operational modes of the device of FIGS. 1 and 2.

With reference to FIG. 3A, the aforementioned fluid outlet is shown by the reference numeral 12*c* and is located at the other side wall of the casing 12 opposite the inlet 12*a*. Also, an additional inlet 12*d* for atmospheric air is provided in the lower wall of the casing 12 and communicates with the chamber in the casing. The manifold connects the air inlets 12*b* and 12*d* and thus allows air to flow from the former to the latter. Although not shown in the drawings, it is understood that appropriate slots are formed in the casing 12 to communicate the manifold 16 with the inlets 12*b* and 12*d*.

According to a feature of the invention, a partition 46 (also shown in FIGS. 1 and 2) is provided in the inlet 12*b* to divide the inlet into two chambers one of which communicates with the interior of the casing 12 as shown in FIG. 3A. The other chamber is connected, via the manifold 16, to the inlet 12*d* which also communicates with the interior of the casing 12. The purposes and advantages of the partition 46 will be described in detail.

In operation, the shaft 26 is rotated by the power source connected to the shaft extension 26*a*. This rotates the impeller 22 in a counterclockwise direction as viewed in FIG. 3A–3C, which, in turn, drives the impeller 20 in a clockwise direction. During this rotation, each of the pockets between the adjacent lobes of the impellers 20 and 22 sequentially rotates into fluid communication with the inlet 12*a* of the casing 12 to receive the low pressure fluid to be processed, which, for example, is air. As the lobes sequentially rotate along the corresponding inner wall of the casing 12, the fluid in the pockets is trapped within a chamber formed between each pocket and the latter wall and is transported to the outlet 12*c*, as shown by the solid arrows.

Figure 3B:
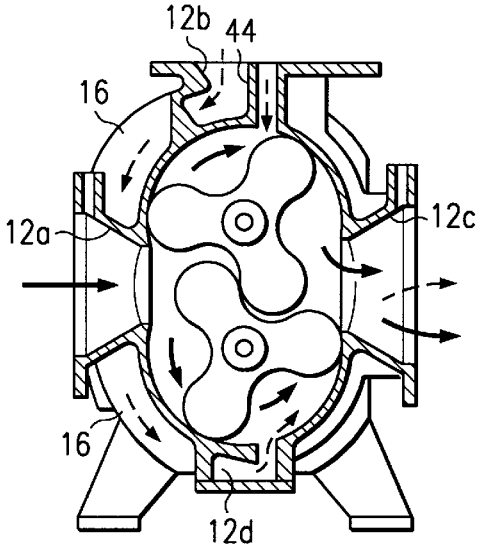

Similarly, each of the pockets between the adjacent lobes of each impeller 20 and 22 sequentially rotates into fluid communication with the outlet 12*c* to discharge the fluid in the pockets, which is at a relatively high pressure. The high pressure fluid can then be routed to external equipment (not shown) for further use or processing. The operation is continuous, that is, the fluid at a relatively low pressure is simultaneously drawn into the inlet, and is discharged at a relatively high pressure from the outlet 12*c*, with FIGS. 3A–3C showing different positions of the impellers 20 and 22 during this operation.

During this movement of the impellers 20 and 22, their respective lobes move past the atmospheric air inlet 12*b*. This draws atmospheric air into the inlet 12*b* and a portion of this air passes though that portion of the inlet extending to the right of the partition 46 as viewed in FIGS. 3A–3C and directly into the chamber of the casing 12 and mixes with the fluid being processed by the impeller 20 in the above manner, to cool the fluid during its passage through the casing 12. The remaining portion of the atmospheric air entering the inlet 12*b* passes through that portion of the inlet extending to the left of the partition 46 as viewed in FIGS. 3A–3C and, via the manifold 16, to the lower inlet 12*d* and thus is also drawn into the chamber and mixes with the fluid being processed by the impeller 22. This flow of the atmospheric air into the chamber via the inlets 12*b* and 12*d* is shown by the dashed arrows in FIGS. 3A–3C.

Figure 3C:
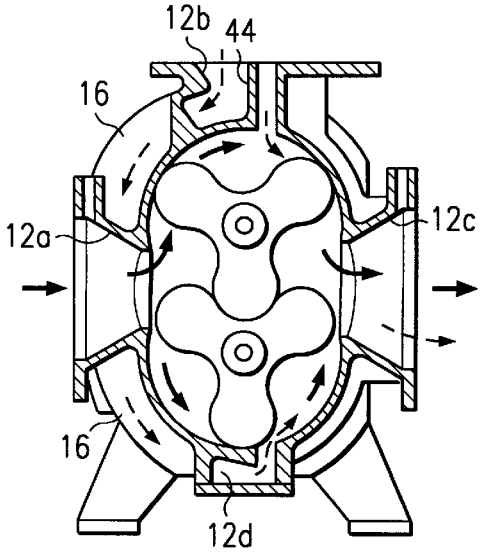

However, when the impeller 22 is in the position shown in FIG. 3C, the relatively high pressure-high temperature fluid being discharged from the fluid outlet 12*c* can backflow into the air inlet 12*d* and be carried, via the manifold 16, to the air inlet 12*a* for reintroduction into the chamber in the casing 12. This is disadvantageous since it would heat the relatively cool atmospheric air entering the latter chamber through the inlet 12*b*. However, this is avoided by the partition 46 which isolates any of the backflowing fluid from that portion of the inlet 12*a* that communicates with the chamber. Thus, the cooling, atmospheric air entering that portion of the inlet 12*b* communicating with the chamber of the casing 12 is not preheated by the backflowing fluid.

Several advantages result from the foregoing since the pre-heating of the cooling air is reduced and the above-mentioned problems associated with a bolt-on manifold are eliminated.

Although the expression "fluid flow device" has been used throughout the above description and will be used in the following claims, it is understood that it is meant to include other commonly used terms for this type of unit or for similar types of units, such as "vacuum pump", "compressor", "blower", and the like.

It is also understood that variations may be made in the foregoing without departing from the scope of the invention. For example, a different number of impellers, and a different number of lobes on each impeller can be used within the scope of the invention.

It is understood that other variations may be made in the foregoing without departing from the scope of the invention. For example, Since other modifications, changes, and substitutions are intended in the foregoing disclosure, it is appropriate that the appended claims be construed broadly and in a manner consistent with the scope of the invention.

What is claimed is:

1. A fluid flow device comprising a casing having a fluid inlet for receiving the fluid, a fluid outlet for discharging the fluid, a chamber extending between the inlet and the outlet, and an air inlet for introducing atmospheric air into the chamber; and at least one impeller mounted for rotation in the chamber to flow the fluid from the fluid inlet to the fluid outlet, the impeller drawing the atmospheric air into the chamber; and a partition that divides the air inlet into a first portion that communicates with the chamber and a second portion for preventing the fluid at the fluid outlet from backflowing into the air inlet.

2. The device of claim 1 wherein the casing further comprises an additional air inlet located in a spaced relation to the first-mentioned air inlet and communicating with the chamber.

3. The device of claim 2 further comprising means for connecting the first-mentioned air inlet to the additional air inlet so that the second portion of the air passes from the first-mentioned air inlet to the additional air inlet for passage into the chamber.

4. The device of claim 3 wherein the latter means is a manifold.

5. The device of claim 4 wherein the partition prevents the fluid at the fluid outlet from backflowing through the additional air inlet, through the manifold and to the first-mentioned air inlet.

6. The device of claim 5 wherein the manifold is formed integrally with the casing.

7. The de vice of claim 2 wherein the first-mentioned air inlet i s located at the upper portion of the casing and the additional air inlet is located at the lower portion of the casing.

8. A fluid flow device comprising a casing having a fluid inlet for receiving the fluid, a fluid outlet for discharging the fluid, a chamber extending between the inlet and the outlet, two spaced air inlets; a partition dividing the first air inlet into a first portion that communicates with the chamber for introducing a first portion of atmospheric air into the chamber and a second portion for receiving additional atmospheric air; a manifold for connecting the second portion of the first air inlet to the second air inlet for passing the additional atmospheric air from the former to the latter; at least one impeller mounted for rotation in the chamber to flow the fluid from the fluid inlet to the fluid outlet, the impeller drawing the atmospheric air into the chamber through the first portion of the first air inlet and drawing the additional atmospheric air from the second portion of the first air inlet to the second air inlet and into the chamber; and, the partition preventing the fluid at the fluid outlet that backflows into the second air inlet from entering the first portion of the first air inlet.

9. The device of claim 8 wherein the backflowing fluid passes from the second air inlet, through the manifold and to the second portion of the first air inlet but is prevented from flowing into the first portion of the first air inlet by the partition.

10. The device of claim 8 wherein the first-mentioned air inlet is located at the upper portion of the casing and the additional air inlet is located at the lower portion of the casing.

11. The device of claim 8 wherein the impeller includes at least two lobes the outer surfaces of which extend, with minimal clearance, relative to the corresponding portion of the wall of the casing defining the chamber, so that the fluid is trapped between adjacent lobes and the latter wall portion.

12. The device of claim 8 wherein there are two impellers each of which has three lobes.

13. The device of claim 8 wherein the manifold is formed integrally with the casing.

14. A fluid flow device comprising a casing having a fluid inlet for receiving the fluid, a fluid outlet for discharging the fluid, a chamber extending between the inlet and the outlet, and an air inlet for receiving atmospheric air; a partition dividing the air inlet into a first portion and a second portion, the first portion of the air inlet communicating directly with the chamber for introducing the air directly into the chamber; a manifold connecting the second portion of the air inlet to the chamber; at least one impeller mounted for rotation in the chamber to flow the fluid from the fluid inlet to the fluid outlet; the impeller passing the air through the first portion of the air inlet directly into the chamber, and passing the air through the second portion of the air inlet, through the manifold, and into the chamber.

15. The device of claim 14 wherein the partition prevents the backflow of fluid from the chamber, through the manifold and through the first portion of the air inlet.

* * * * *